United States Patent [19]

Brauner

[11] 4,360,147

[45] Nov. 23, 1982

[54] SEMI-DOMED PAPERBOARD FOOD CARTON

[75] Inventor: Arne H. Brauner, 3 Lake Rd., Peekskill, N.Y. 10566

[73] Assignee: Arne H. Brauner, Peekskill, N.Y.

[21] Appl. No.: 267,175

[22] Filed: May 26, 1981

[51] Int. Cl.[3] ..... B65D 5/22

[52] U.S. Cl. ..... 229/33; 229/36; 229/44 R

[58] Field of Search ..... 229/23 BT, 33, 44 R, 229/36, 31 R, 30, 23 R

[56] References Cited

U.S. PATENT DOCUMENTS

| | | | |
|---|---|---|---|
| 2,846,132 | 8/1958 | Carpenter | 229/31 |
| 2,975,953 | 3/1961 | Muth | 229/45 |
| 3,027,062 | 3/1962 | Huss | 229/23 |
| 3,100,074 | 8/1963 | Beck | 229/44 |
| 3,326,447 | 6/1967 | Williamson | 229/44 |
| 3,827,624 | 8/1974 | Dogliotti | 229/45 |
| 3,876,130 | 4/1975 | Haase | 229/2.5 |
| 3,968,922 | 7/1976 | Ruud | 229/33 |
| 4,098,453 | 7/1978 | Arneson | 229/45 |
| 4,127,189 | 11/1978 | Shumrak | 206/520 |
| 4,136,816 | 1/1979 | Gardner | 229/33 |
| 4,232,816 | 11/1980 | Johnson et al. | 229/33 |
| 4,266,713 | 5/1981 | Maroszek | 229/33 |
| 4,331,238 | 5/1982 | Hanko et al. | 229/33 X |
| 4,339,068 | 7/1982 | Brauner | 229/33 |

*Primary Examiner*—William Price
*Assistant Examiner*—Gary E. Elkins
*Attorney, Agent, or Firm*—Penelope A. Smith

[57] ABSTRACT

A nestable paperboard food carton comprising a bottom tray, a semi-domed top cover with upper side panels that substantially overlap the lower side panels of the bottom tray and an upper front panel that extends substantially to the junction of the base panel and the lower front panel of the bottom tray, hinge means, connecting the bottom tray to the top cover, and preferably, a locking feature for securing the carton in its closed position, is provided.

9 Claims, 9 Drawing Figures

SEMI-DOMED PAPERBOARD FOOD CARTON

BACKGROUND OF THE INVENTION

This invention relates to a nestable paperboard food carton that converts into a two-compartment serving tray. Many food products, such as sandwiches, hamburgers, and the like, are packaged in paperboard cartons and are sold by fast service restaurants. Since fast service restaurants generally have limited storage space, it is desireable that the unfilled cartons be nestable to save storage space. Since fast service food products are often eaten away from the restaurant premises, it is also desireable that the closed carton provide some degree of protection against heat loss and debris for the food product. Furthermore, since fast food products are generally to be eaten without plates, it is desireable for such food cartons to be able to act as serving trays, and since the sandwiches are frequently purchased with other food items such as french fried potatoes, it is especially useful for the trays to form two serving compartments.

SUMMARY OF THE INVENTION

This invention provides a nestable paperboard food carton that can be filled and closed rapidly and can be used as a two-compartment serving tray when opened. The carton comprises a bottom tray, a semi-domed top cover with upper side panels that substantially overlap the lower side panels of the bottom tray and an upper front panel that extends substantially to the junction of the base panel and the lower front panel of the bottom tray, hinge means, preferably a scored or scored-and-perforated line, connecting the bottom tray to the top cover, and preferably, a locking feature for securing the carton in its closed position.

The full nature of the invention will be understood from the accompanying drawings and the following description and claims. It should be understood, however, that references in the following description to the front, rear, and side panels and locking feature are for convenience of description, and such terms are not intended to be used in a limiting sense.

DETAILED DESCRIPTION OF THE INVENTION

Figure 1:
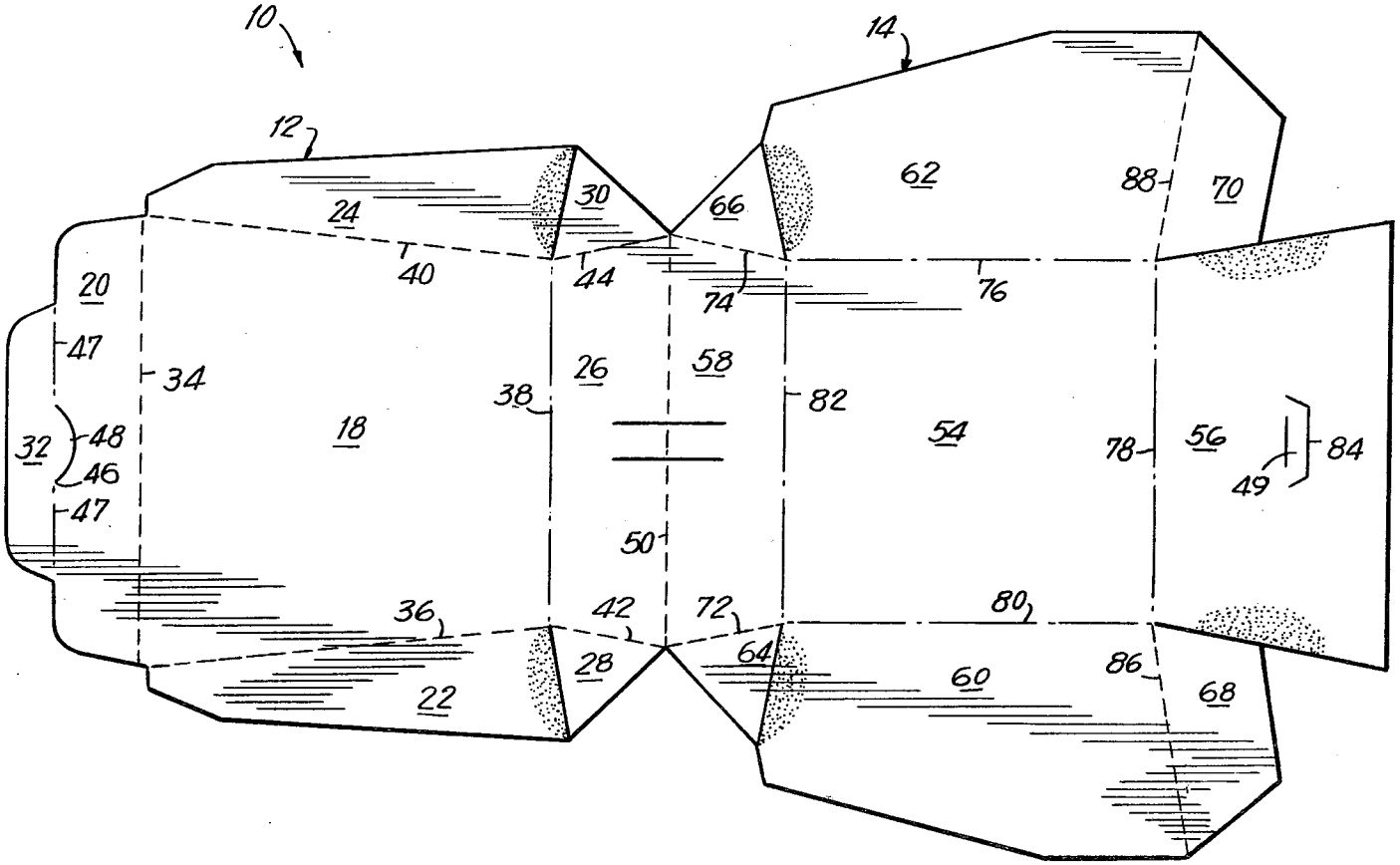
FIG. 1 is a top plan view of the cut and scored, unitary blank that is used to form the carton illustrated in FIGS. 2–6.

Reference is first made to FIG. 1 for a description of the blank employed in forming the carton illustrated in FIGS. 2–6. Unitary blank 10 comprises bottom tray-forming section 12, top cover-forming section 14, and hinge means 50 connecting the bottom tray-forming section 12 to top cover-forming section 14.

Bottom tray-forming section 12 comprises a substantially trapezoidal base panel 18, a front closure panel 20, a substantially trapezoidal lower back panel 26, and a pair of lower side panels 22, 24. Front closure panel 20 is hingedly connected to base panel 18 along score line 34. Lower side panels 22, 24 are hingedly connected to base panel 18 along score lines 36, 40, respectively, and lower back panel 26 is hingedly connected to base panel 18 along score line 38. A pair of first glue flaps 28, 30 are hingedly connected to opposite edges of lower back panel 26 along score lines 42 and 44, respectively.

Front closure panel 20 is hingedly connected to closing flap 32 along slit line 46 and score line 47. A semicircular line of cut, 46, forms the center portion of score line 47 thereby forming an integral locking tab 48 which, as will be explained below, is adapted to releasably engage a locking slot formed in the front panel of the top cover.

The top cover-forming section 14 comprises a substantially square top panel 54 which is hingedly connected to a pair of upper side panels, 60 and 62, along score lines 80, 76, respectively; to a substantially trapezoidal upper back panel 58 along score line 82; and to front panel 56 along score line 78. Each of the upper side panels is shaped like a trapezoid, or preferably a quasitrapezoid with truncated exterior corners. Truncating these exterior corners provides substantial paper savings when multiple blanks are cut from a single web by allowing the blanks to be placed closer together on the web. A pair of second glue flaps 64 and 66 are hingedly connected to opposite edges of upper back panel 58 along score line 72 and 74, respectively and a pair of third glue flaps 68 and 70 are hingedly connected to upper side panels 60 and 62 along score lines 86 and 88, respectively.

Front panel 56 includes a locking slot 84, which is formed by an incision in the front panel 56. Tab 48 engages slot 84 to secure the front closure panel 20 to the front panel 56 when the carton contains the food product and is in the closed position. In the preferred embodiment, a 50% cut line of weakness, 49, is provided to facilitate the opening of the slot 84.

Figure 7:
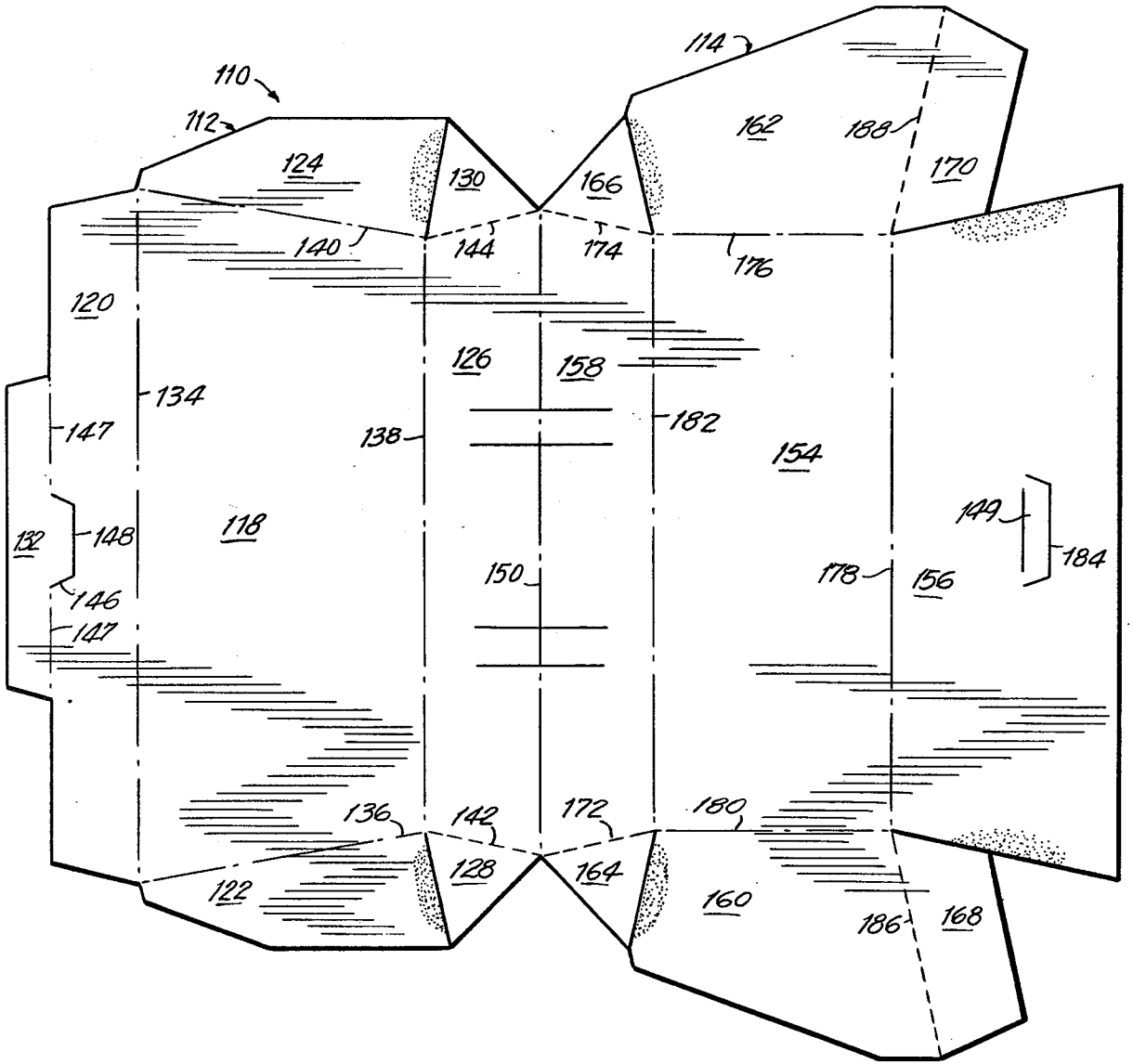
FIG. 7 is a top plan view of the cut and scored, unitary blank that is used to form the carton illustrated in FIGS. 8 and 9.
Figure 8:
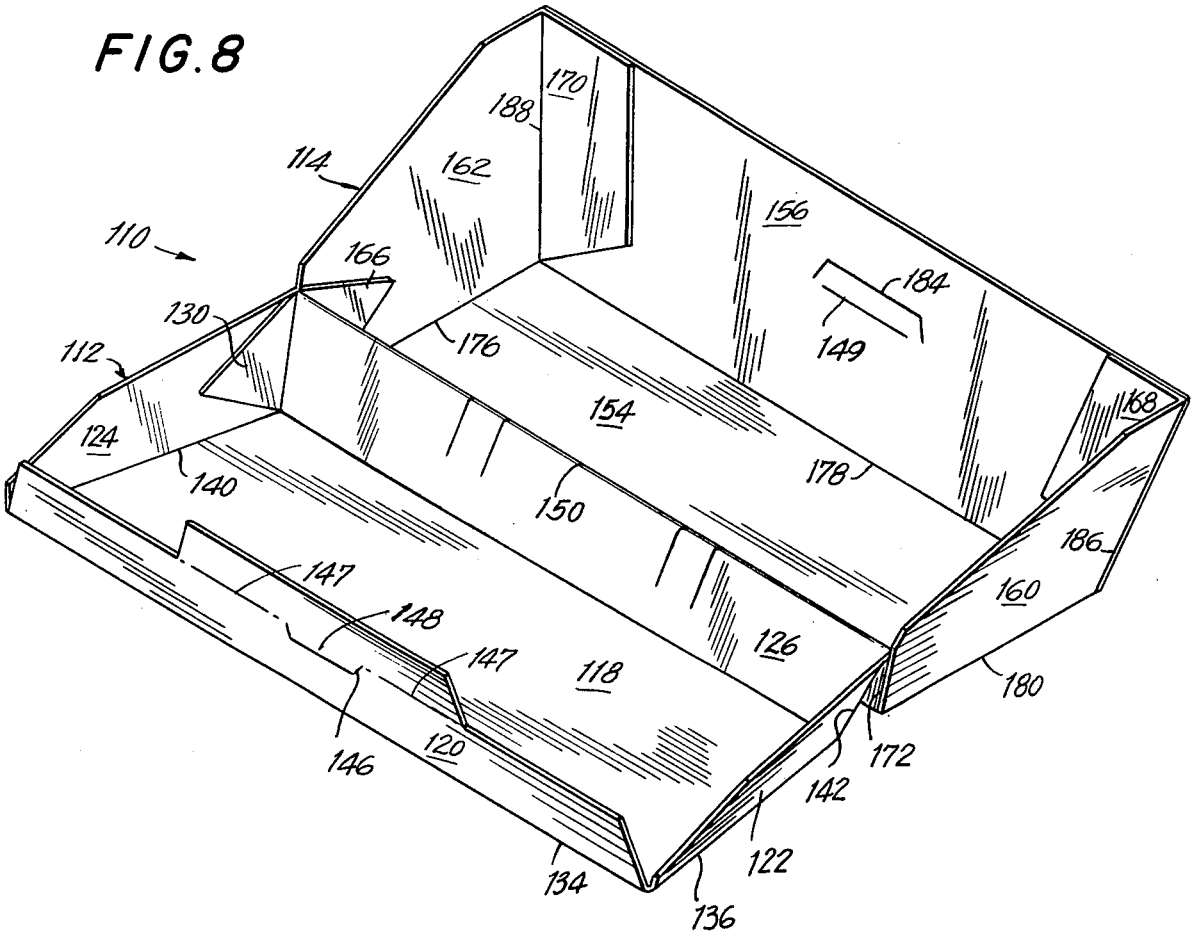
FIG. 8 is a front perspective view of the carton erected from the blank of FIG. 7 in the open position.
Figure 9:
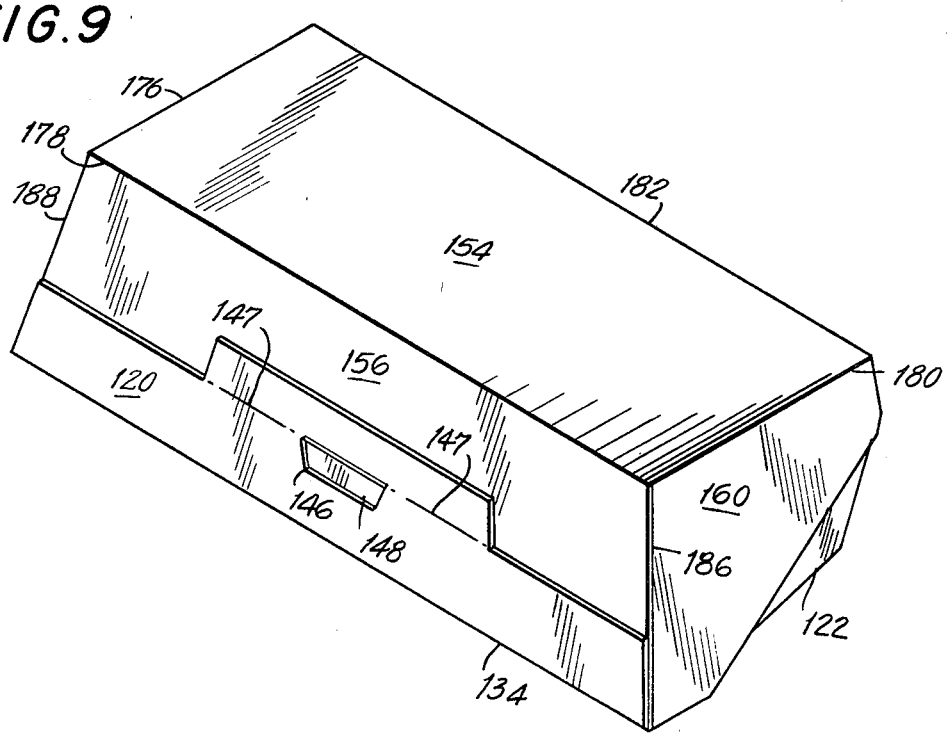
FIG. 9 is a front perspective view of the carton of FIG. 8 in the closed position.

An alternative embodiment of the carton of my invention is illustrated in FIGS. 7–9. Unitary blank 110, shown in FIG. 7, comprises bottom tray-forming section 112, top cover-forming section 114, and hinge means 150 connecting the bottom tray-forming section 112 to top cover-forming section 114.

Bottom tray-forming section 112 comprises a substantially trapezoidal base panel 118, a front closure panel 120, a substantially trapezoidal lower back panel 126, and a pair of lower side panels 122, 124. Front closure panel 120 is hingedly connected to base panel 118 along score line 134. Lower side panels 122, 124 are hingedly connected to base panel 118 along score lines 136, 140, respectively, and lower back panel 126 is hingedly connected to base panel 118 along score line 138. A pair of first glue flaps 128, 130 are hingedly connected to opposite edges of lower back panel 126 along score lines 142 and 144, respectively.

Front closure panel 120 is hingedly connected to closing flap 132 along slit line 146 and score line 147. A line of cut, 146, forms the center portion of score line 147 thereby forming an integral locking tab 148 which, as will be explained below, is adapted to releasably engage a locking slot formed in the front panel of the top cover.

The top cover-forming section 114 comprises a substantially rectangular top panel 154 which is hingedly connected to a pair of quasi-trapezoidal upper side panels, 160 and 162, along score lines 180, 176, respectively; to a substantially trapezoidal upper panel 158 along score line 182; and to front panel 156 along score line 178.

A pair of second glue flaps 164 and 166 are hingedly connected to opposite edges of upper back panel 158 along score line 172 and 174, respectively—and a pair of third glue flaps 168 and 170 are hingedly connected to upper side panels 160 and 162 along score lines 186 and 188, respectively.

Front panel 156 includes a locking slot 184, which is formed by an incision in the front panel 156. Tab 148 engages slot 184 to secure the front closure panel 120 to the front panel 156 when the carton contains the food product and is in the closed position. In the preferred embodiment, a 50% cut line of weakness, 149, is provided on the outside surface of the blank to facilitate the opening of the slot 184.

As shown in FIGS. 1 and 7, the top cover and the bottom tray are attached to one another by hinge means, preferably a perforated scored line, connecting the outer edge of the lower back panel of the bottom tray to the outer edge of the upper back panel of the top cover. As was mentioned previously, the score line which constitutes the preferred hinge means is longer than either score lines 38 and 182 or score lines 138 and 82 so that the upper and lower back panels are trapezoidal. This configuration permits the top cover: (a) to partially overlie and frictionally engage the upper edges of the bottom tray 12 to form a heat and vapor trap when the carton is closed; and (b) to pivot from the lower rear panel of the bottom tray when the carton is opened to thereby form a nestable two-compartment serving tray. As employed herein, outer edge means that edge of the lower back panel that is furthest away from the base panel and that edge of the upper back panel that is furthest away from the top panel.

Figure 2:
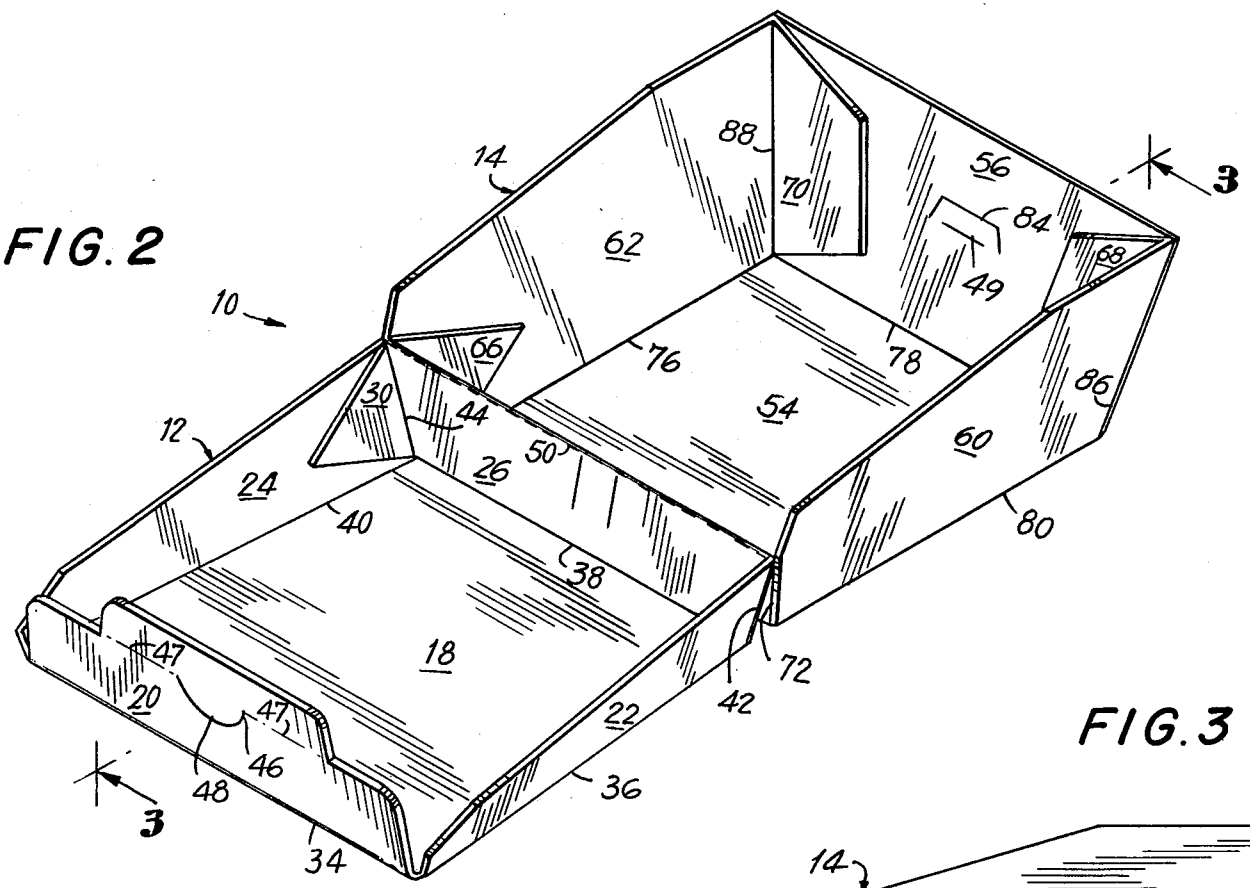
FIG. 2 is a front perspective view of the carton erected from the blank of FIG. 1 in the open position.
Figure 3:
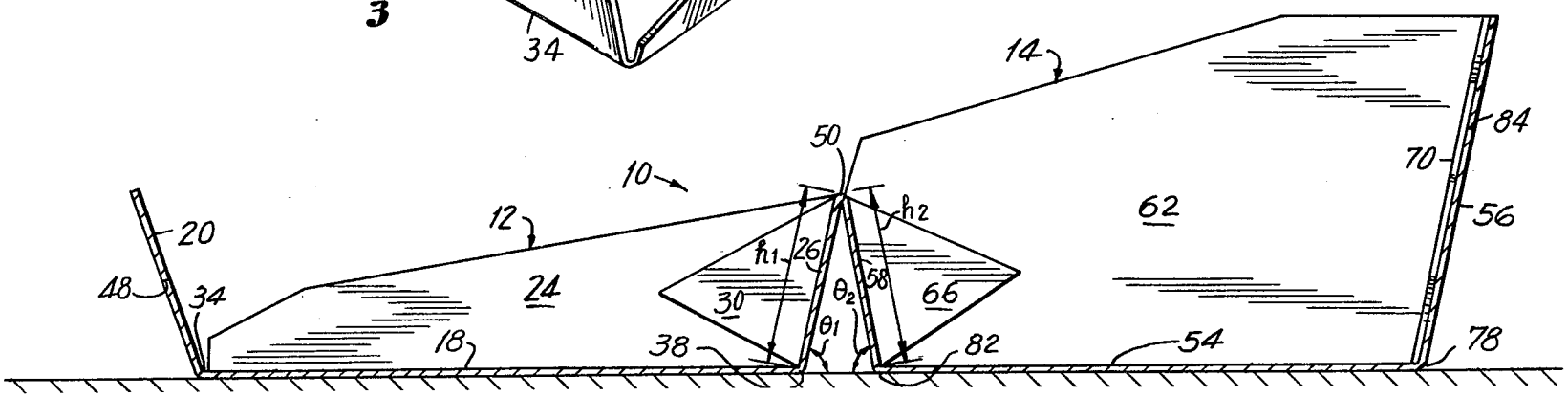
FIG. 3 is a cross-sectional view taken along line 3—3 of FIG. 2.

As is shown in FIGS. 2, 3, and 8, both the square-topped carton fabricated from the unitary blank 10 which is illustrated in FIG. 1 and the rectangular-topped carton fabricated from the blank 110 shown in FIG. 7 will, when opened, form two food serving trays or compartments. In the preferred embodiments, each compartment is adapted to lie securely in the same horizontal plane when placed on a flat surface. The first serving compartment is formed from the bottom tray 12 or 112 and the second serving compartment is formed from the domed top cover 14 or 114. The bottom tray comprises a base panel, two lower side panels, a front closure panel and a lower back panel 26. The top cover comprises a top panel, two upper side panels, a front panel and an upper back panel. Connecting the bottom tray to the semi-domed top cover is a hinge means which is preferably a score line or a perforated score line.

The unique configuration of the carton blanks of my invention permit the blanks to be glued at six points, on relatively standard equipment, such as Kliklok HSWD or FFWD machine, having tooling modified for this carton. For example, in assembling the square-topped carton each of the first glue flaps, 28, 30 on bottom tray 12 is glued to the inner surface of one of the lower side panels 22, 24; each of the second glue flaps 64, 66 is glued to the inner surface of one of the upper side panels 60, 62; and a pair of third glue flaps 68, 70 are flued to the inner surface of front panel 56. Similarly, in assembling the rectangular—topped carton, each of the first glue flaps 128, 130 is glued to the inner surface of one of the lower side panels 122, 124; each of the second glue flaps 164, 166 is glued to the inner surface of one of the upper side panels 160, 162; and a pair of third glue flaps 168, 170 are glued to the inner surface of front panel 156. In the preferred embodiments, the top back corners of the upper side panels and the lower back corners of the lower side panels form obtuse angles (e.g. in the glued square-topped carton shown in FIG. 3 the angles between score lines 72 and 80, between score lines 76 and 66, between score lines 40 and 44, and between score lines 36 and 42 are all somewhat greater than 90°). Hence, the upper and lower back panels form two sides of an acute triangle when the carton is opened which contributes to its stability in the open position and allows multiple stacked cartons to nest into one another. It also allows the top cover to pivot and swing into such a position that front panel extends substantially to the score line at the front of bottom tray and the upper side panels partially overlie and frictionally engage the upper edges of lower side panels so that the food product is fully covered when the carton is in the closed position illustrated in FIGS. 4, 5, 6, and 9. The carton may be opened by the ultimate user in such a manner that base tray can be used as a receptacle for a fast food product, such as a sandwich or a hamburger, and domed top cover can be used as a receptacle for a second food product such as french fried potatoes.

Figure 6:
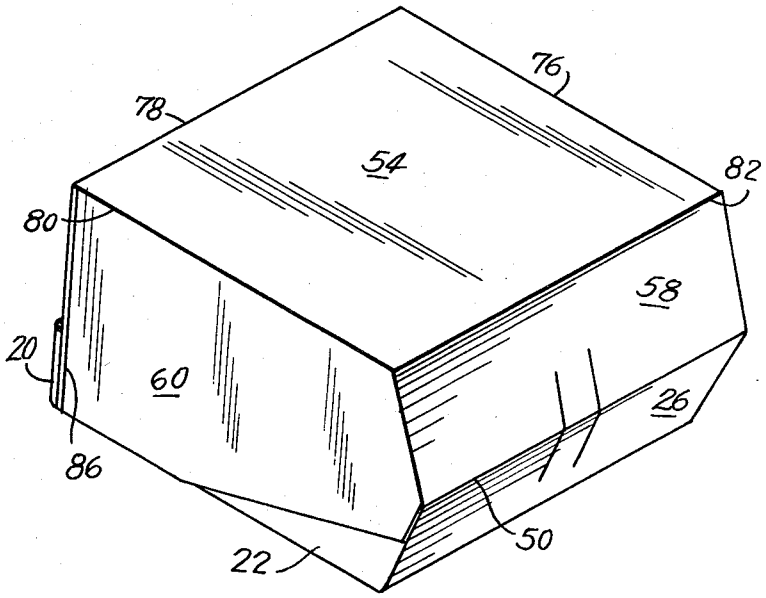
FIG. 6 is a back perspective view of the carton shown in FIG. 4.
Figure 5:
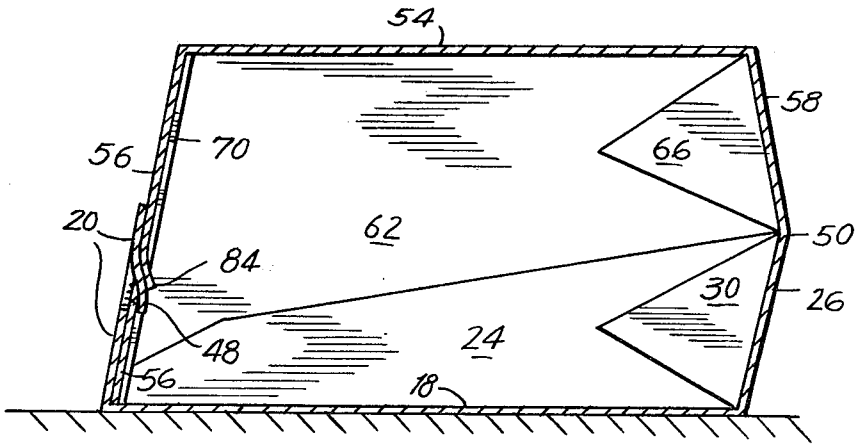
FIG. 5 is a cross-sectional view taken along line 5—5 of FIG. 4.

As is evident in FIGS. 5 and 6 (and also FIG. 9), when the carton is glued and erect, the sloping upper edges of the lower side panels abut and frictionally engage the inner walls of the upper side panels along substantially their entire length. This construction permits the cover to be flexible in its function; when the carton is closed, the position of the semi-domed cover retards the escape of moisture vapor and heat from the food product, and when the carton is open, the semi-domed cover acts as a second food compartment. As FIGS. 3 and 8 indicate, the continuously sloping profiles of the opened cartons of my invention permits easy frontal access to both compartments in a convenient and esthetically pleasing manner.

In the most preferred embodiments, such as the one shown in FIG. 3, the height, h2, of upper panel 58 of top cover 14 is substantially equal to the height, h1, of the lower rear panel 26 of bottom tray 12. The invention does not require this configuration, however; the upper rear panel may be either longer and more sharply slanted or shorter and straighter than the lower rear panel and yet be within the scope of my invention so that a variety of unusually shaped cartons may be provided in accordance with the marketing and packaging requirements of the food vendor. As indicated in FIG. 3, configurations where $h_1 \sin_1 = h_2 \sin_2$ are preferred since these configurations allow the top and bottom sections of the carton to lie securely in the same horizontal plane when the opened carton is placed on a flat surface.

Figure 4:
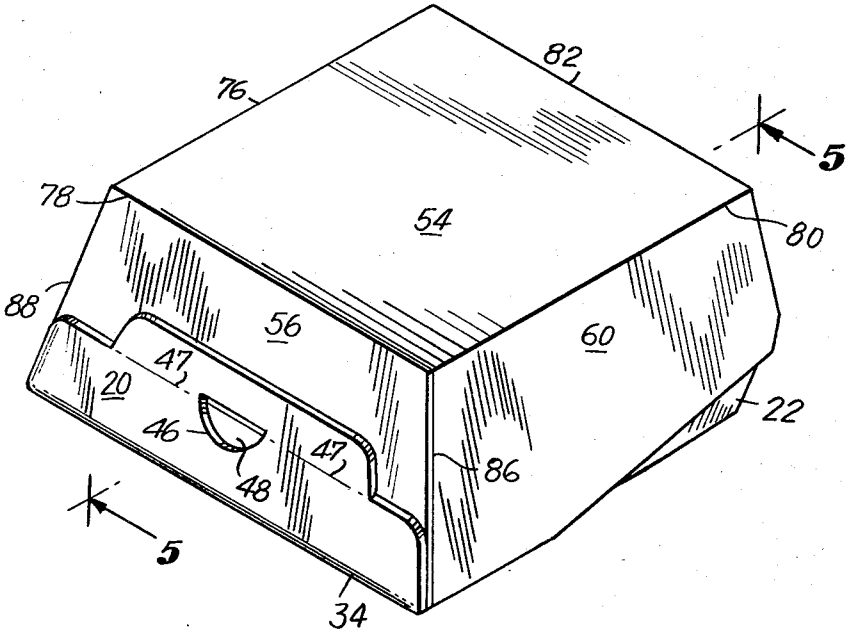
FIG. 4 is a front perspective view of the carton erected from the blank of FIG. 1 in the closed position.

As is illustrated in FIGS. 4 and 9, the top cover can be locked to the bottom tray by the engagement of latching means, namely, slipping the locking tab on the closing flap into the locking slot which is formed by an incision in the front panel of the top cover. To open one of the closed cartons illustrated in FIGS. 4 and 9 the user simply grasps the closing flap, gently separates it from the carton, and then raises the top cover, thereby allowing the top cover to pivot around the hinge means to form one of the two-compartment serving trays illustrated in FIGS. 2 and 8.

The cartons of my invention, such as those formed from the blanks illustrated in FIGS. 1 and 7, may be made from any suitable foldable material. Preferably, they are made of paperboard or the like, and suitable paperboard stock, for example, is 0.014 SBS. The surfaces of the cartons may also be coated with barrier materials to aid in retaining the heat and moisture from the food products. For example, the exteriors of the cartons may be coated with a saran-type coating, which acts as a moisture vapor barrier. The interiors of the cartons may be coated with solvent-based nitrocellulose coatings or with aqueous, modified acrylic coatings, which provide a liquid moisture barrier and a degree of grease resistance. It will be recognized, however, that certain food products will permit the use of uncoated cartons.

Generally speaking, the present invention is directed to a food carton formed from a unitary blank of foldable paperboard that converts into a two-compartment serving tray for products such as sandwiches, hamburgers, and the like. It comprises a bottom tray, a top cover, and hinge means connecting the bottom tray to the top cover. Reciprocal locking means for securing the front panel of the top cover to the front closure panel of the bottom tray are also provided in the preferred embodiment. The bottom tray comprises a trapezoidal base panel, a front closure panel, a lower back panel, and a pair of lower side panels, each hingedly connected to, and extending from, the trapezoidal base panel. The semi-domed top cover comprises a substantially rectangular top panel, a trapezoidal front panel, an upper back panel, and a pair of trapezoidal or quasi-trapezoidal upper side panels, each hingedly conected to, and extending from, the top panel. The combination of rectangular, trapezoidal, and semi-trapezoidal panels is adapted to allow open, unfilled cartons to nest when stacked, to permit the top cover to partially overlie and frictionally engage the edges of the bottom tray to form a trap for vapor and heat and a barrier against debris when the filled carton is closed, and to form two food-serving compartments when the filled carton is opened by the ultimate consumer.

Although the invention has been described above by reference to preferred embodiments, it will be appreciated that other carton constructions may be devised, which are, nevertheless, within the scope and spirit of the invention and are defined by the claims appended hereto.

What is claimed is:

1. A food carton formed from a unitary blank of foldable paperboard comprising:

a bottom tray; a top cover; and hinge means connecting said bottom tray to said top cover;

said bottom tray comprising:

a substantially trapezoidal base panel;

a front closure panel, a lower back panel, and a pair of lower side panels, each hingedly connected to, and extending from, said base panel;

said top cover comprising:

a substantially rectangular top panel;

a substantially trapezoidal upper front panel, an upper back panel, and a pair of upper side panels, each hingedly connected to, and extending from, said top panel;

wherein the upper front panel extends substantially to the junction of the front closure panel and the base panel and the upper side panels partially overlie and frictionally engage the upper edges of the lower side panels whereby a heat and vapor trap is provided when the carton is in a closed position, and the carton is nestable with similar cartons when said cartons are stacked in an open position.

2. A carton according to claim 1 further comprising locking means for securing said bottom tray to said top cover when said carton is in a closed position.

3. A paperboard food carton according to claims 2 wherein the lower back panel forms an obtuse angle with the base panel and the upper back panel forms an obtuse angle with the top panel whereby the lower back panel and upper back panel form the sides of an acute trangle and the stablility of the carton is enhanced when the carton is in an open position.

4. A carton according to claim 3 wherein a first pair of glue flaps is hingedly connected to opposed edges of the lower back panel, said first pair of glue flaps being glued to the respective lower side panels when the carton is erect; and wherein a second pair of glue flaps is hingedly connected along opposed edges of the upper back panel, said second pair of glue flaps being glued to the respective upper side panels when the carton is erect; and wherein a third pair of glue flaps is hingedly connected to the edges of the upper side panels, said third pair of glue flaps being glued to the upper front panel when the carton is erect.

5. A carton according to claim 4, wherein the upper back panel is substantially trapezoidal and wherein the lower back panel is substantially trapezoidal.

6. A carton according to claim 5 wherein said locking means comprises a closing flap hingedly connected to the front closure panel of said bottom tray, the closing flap including an integrally formed locking tab, and wherein said locking means further comprises a locking slot integrally formed in the upper front panel and adapted to releasably engage the locking tab on the closing flap to securely close said carton.

7. A carton according to claim 6 wherein the substantially rectangular top panel consists of a substantially square top panel.

8. A unitary blank being suitably cut and scored and adapted to be erected into a nestable carton for a food product, said blank comprising a bottom tray-forming section; a top-cover forming section, and a score line hingedly connecting said bottom tray-forming section to said top cover-forming section;

wherein said bottom tray-forming section comprises a substantially trapezoidal base panel, a pair of lower side panels hingedly connected to a first pair of opposed edges of said base panel, a front closure panel and a lower back panel hingedly connected to a second pair of opposed edges of said base panel; and a pair of first glue flaps hingedly connected to opposed side edges of said lower back panel;

wherein said top cover-forming section comprises a substantially rectangular top panel, a pair of upper side panels hingedly connected along a first pair of opposed edges of said top panel, an upper back panel and a substantially trapezoidal upper front hingedly connected to a second pair of opposed edges of said top panel, a second pair of glue flaps hingedly connected to proposed side edges of said upper back panel, and a third pair of glue flaps hingedly conected to the edges of said upper side panels; and wherein said top cover-forming section is adapted to partially overlie and frictionally engage the bottom tray-forming section when the blank is erected into a carton and the carton is in a closed position.

9. A blank according to claim 8 wherein the front closure panel and the upper front panel further comprise reciprocal locking means for securing the erected carton in a closed position.

* * * * *

UNITED STATES PATENT AND TRADEMARK OFFICE

CERTIFICATE OF CORRECTION

PATENT NO. : 4,360,147

DATED : 11/23/82

INVENTOR(S) : Arne H. Brauner

It is certified that error appears in the above-identified patent and that said Letters Patent are hereby corrected as shown below:

On the title page, Item (73) Assignee:, delete "Arne H. Brauner, Peekskill, N.Y." and substitute -- International Paper Company, New York, N.Y. --.

Signed and Sealed this

Twenty-ninth Day of March 1983

[SEAL]

Attest:

GERALD J. MOSSINGHOFF

Attesting Officer

Commissioner of Patents and Trademarks